US006568025B2

(12) United States Patent
Waldron et al.

(10) Patent No.: US 6,568,025 B2
(45) Date of Patent: May 27, 2003

(54) VACUUM CLEANER HAVING UPRIGHT HANDLE WITH TRANSLUCENT TRAY FOR SUPPORTING ACCESSORY ATTACHMENTS

(75) Inventors: Michael E. Waldron, Co Durham (GB); Mark Stratford, Darlington (GB); Stacey Ann Main, Baltimore, MD (US); Oleksiy P. Sergyeyenko, Brockville (CA); Jacob R. Prosper, Brockville (CA)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 09/886,941

(22) Filed: Jun. 21, 2001

(65) Prior Publication Data

US 2002/0194694 A1 Dec. 26, 2002

(51) Int. Cl.[7] ..... A47L 9/32
(52) U.S. Cl. ..... 15/323; 15/410
(58) Field of Search ..... 15/323, 339, 350, 15/351, 410; 211/1–209; 248/27–925

(56) References Cited

U.S. PATENT DOCUMENTS

| | | | | |
|---|---|---|---|---|
| 1,936,761 A | | 11/1933 | Hoover | |
| 2,779,047 A | | 1/1957 | Osborn | |
| 2,854,686 A | | 10/1958 | Hansen | |
| 3,020,577 A | | 2/1962 | Carabet | |
| 3,284,834 A | | 11/1966 | Waters | |
| 3,509,590 A | | 5/1970 | Koshiyama | |
| 3,869,265 A | | 3/1975 | Wolter et al. | |
| 4,209,875 A | | 7/1980 | Pugh et al. | |
| 4,249,280 A | | 2/1981 | Goodrich | |
| 4,256,281 A | * | 3/1981 | Harris et al. | 248/230.9 |
| 4,376,322 A | | 3/1983 | Lockhart et al. | |
| 4,467,493 A | | 8/1984 | Buchtel | |
| 4,545,089 A | | 10/1985 | Oxel | |
| 4,907,705 A | * | 3/1990 | Waldeck | 211/85.4 |
| 5,137,156 A | * | 8/1992 | Riczinger et al. | 211/13.1 |
| 5,233,722 A | | 8/1993 | McKnight et al. | |
| 5,247,719 A | | 9/1993 | Wareham et al. | |
| 5,586,358 A | | 12/1996 | Wolfe et al. | |
| 5,713,103 A | | 2/1998 | Keebler et al. | |
| 5,991,971 A | | 11/1999 | Downham | |
| 5,996,175 A | | 12/1999 | Fusco | |
| 6,070,288 A | * | 6/2000 | Luyckx et al. | 15/323 |
| 6,098,241 A | | 8/2000 | Wood | |
| 6,317,920 B1 | | 11/2001 | Brickner et al. | 15/334 |
| 6,317,921 B1 | | 11/2001 | Park et al. | 15/334 |
| 6,374,452 B1 | * | 4/2002 | Essex et al. | 15/323 |

FOREIGN PATENT DOCUMENTS

| | | |
|---|---|---|
| DE | 2333334 | 1/1974 |
| DE | 2834518 | 2/1980 |
| DE | 81 19 955 | 6/1982 |
| DE | 81 18 451 | 12/1982 |
| DE | 3333572 | 5/1984 |
| DE | 3448205 C2 | 10/1988 |
| DE | 19844810 A1 | 9/1999 |
| DE | 19907508 A1 | 8/2000 |
| GB | 2126471 A | 3/1984 |
| WO | WO 94/17716 | 8/1994 |
| WO | WO 95/01748 | 1/1995 |
| WO | WO 00/47101 | 8/2000 |

* cited by examiner

*Primary Examiner*—Terrence R. Till
(74) *Attorney, Agent, or Firm*—Harness, Dickey & Pierce, P.L.C.

(57) ABSTRACT

A vacuum cleaner having an upright handle with a translucent accessory attachment supporting tray. The translucent tray is sandwiched between two housing portions of the handle to help impart structural rigidity to the handle. The tray includes a plurality of recesses formed to partially house specific cleaning attachments. The translucent material of the tray allows a user to see which cleaning attachments are being supported thereon from the front side of the handle and further forms a compact, aesthetically pleasing means for supporting the cleaning attachments.

19 Claims, 4 Drawing Sheets

FIG. 1.
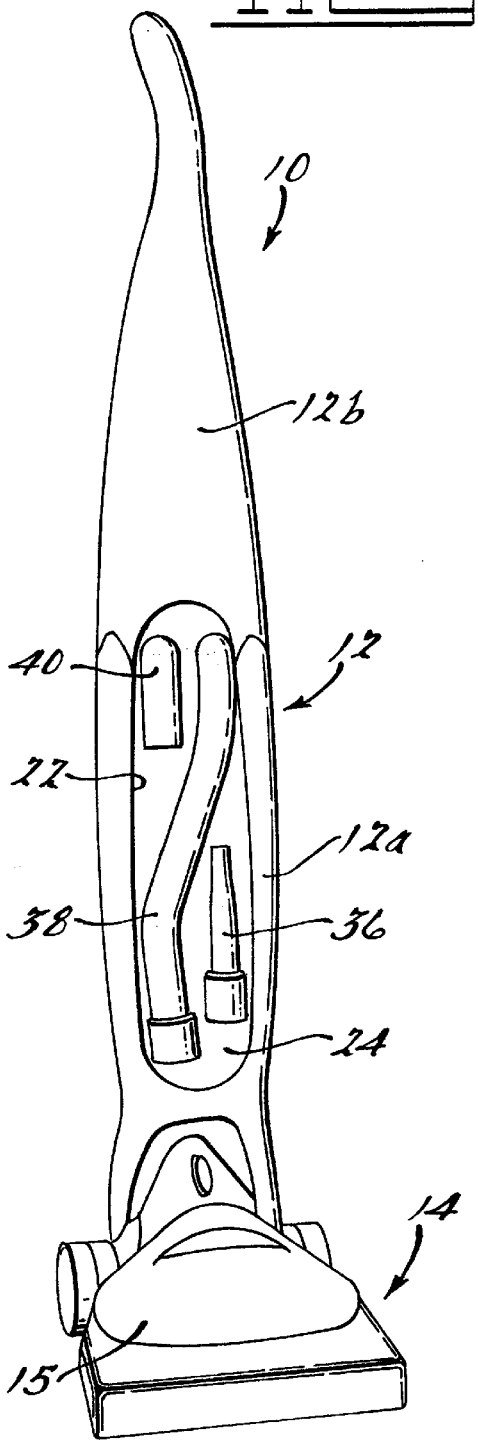
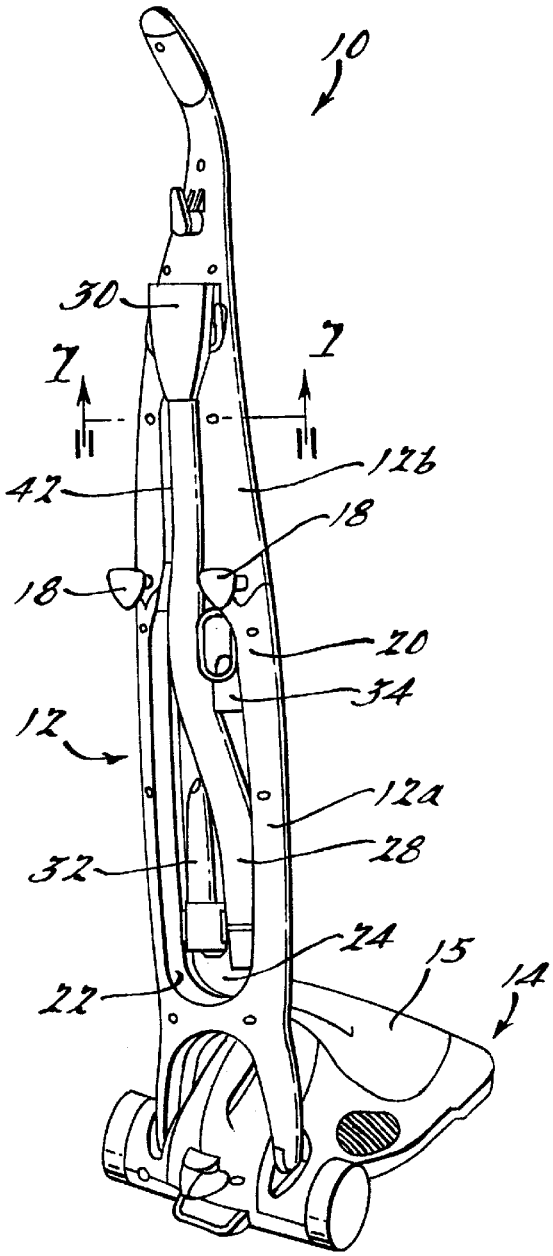
FIG. 2.

VACUUM CLEANER HAVING UPRIGHT HANDLE WITH TRANSLUCENT TRAY FOR SUPPORTING ACCESSORY ATTACHMENTS

FIELD OF THE INVENTION

This invention relates to vacuum cleaners, and more particularly to a vacuum cleaner having an upright handle with a translucent tray for releasably supporting accessory attachments such as crevice cleaning tools, wands and other like cleaning accessory attachments for use with a vacuum cleaner.

BACKGROUND OF THE INVENTION

Vacuum cleaners typically have an upright handle which is secured to a powerhead component. The powerhead often allows the attachment of an auxiliary vacuum hose at some point thereon such that the powerhead can not only be used in a floor cleaning mode, but also in an accessory cleaning mode via the auxiliary vacuum hose attached thereto. Various forms of cleaning attachments such as brushes, crevice cleaning tools, extension wands, etc. are also commonly used with the auxiliary vacuum hose to perform a wide variety of cleaning tasks.

When providing a vacuum cleaner with the capability of performing a variety of cleaning tasks through the use of numerous different cleaning attachments, the problem arises as to how to maintain the various cleaning attachments secured to the vacuum cleaner so that same will not be lost or misplaced. Previously developed vacuum cleaners have typically made use of a variety of clips or other various forms of attachment means for attaching the various accessory cleaning attachments to the upright handle so that same are readily available for use. However, such previously developed securing systems and arrangements often have left the upright handle of the vacuum cleaner looking and feeling bulky, as well as visually unattractive. Still further, such previously developed securing means have often placed the cleaning attachments about the periphery of the upright handle structure, making them susceptible to being jarred loose in the event the handle brushes against a piece if of furniture or other item during use.

It would therefore be highly desirable to provide an upright handle for a vacuum cleaner which includes means for supporting a variety of cleaning attachments on the upright handle in a compact fashion, and which also is visually attractive and which allows the user to see what cleaning attachments are attached to the upright handle, regardless if the user is standing behind or in front of the vacuum cleaner. It would further be desirable if such an upright handle could be provided which is light in weight and is constructed with a minimal number of independent component parts.

SUMMARY OF THE INVENTION

The present invention is directed to a vacuum cleaner having an upright handle assembly with a translucent tray for supporting a plurality of accessory attachments therein. Since the tray is translucent, the user can quickly see, even when standing in front of the vacuum cleaner, which cleaning accessory attachments are being supported on the handle and available for use. The handle also forms an aesthetically appealing component which supports a plurality of cleaning accessory attachments in a compact arrangement.

The upright handle includes an upper portion and a lower portion which are fixedly secured together during initial assembly of the handle by a user after purchase of the invention. The lower handle section includes two housing sections which are secured together in a clamshell-like construction. Each of the housing sections further includes an elongated opening which, when the housing sections are secured together, forms a single, centrally located elongated opening in the lower handle portion.

Before securing the two housing sections of the lower handle portion together, the translucent tray is placed on one of the housing sections. The translucent tray is sandwiched between the housing sections when the two housing sections are assembled together. The translucent tray includes a plurality of recesses formed in accordance with the shapes of predetermined cleaning attachments for partially housing the cleaning attachments therein. At least one securing member is secured to the translucent tray for releasably retaining at least one of the cleaning attachments on the translucent tray.

The upright handle of the present invention forms a means by which a plurality of cleaning attachments can be compactly supported on an upright handle and in a visually appealing manner. Since the user can quickly see through the translucent tray, the user can quickly determine which cleaning attachments are actually being carried on the upright handle and is not required to walk around to the rear of the handle to make this assessment. This further increases the convenience of using a vacuum cleaner associated with the upright handle.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

Referring to FIG. 1, there is shown a perspective view of the vacuum cleaner incorporating an upright handle in accordance with a preferred embodiment of the present invention;

FIG. 3 is an exploded perspective view of the upright handle of FIG. 2 but with the cleaning accessory attachments removed from the handle and with the handle separated into two pieces;

DETAILED DESCRIPTION OF THE PREFERRED EMBODIMENTS

The following description of the preferred embodiment(s) is merely exemplary in nature and is in no way intended to limit the invention, its application, or uses.

Figure 2:
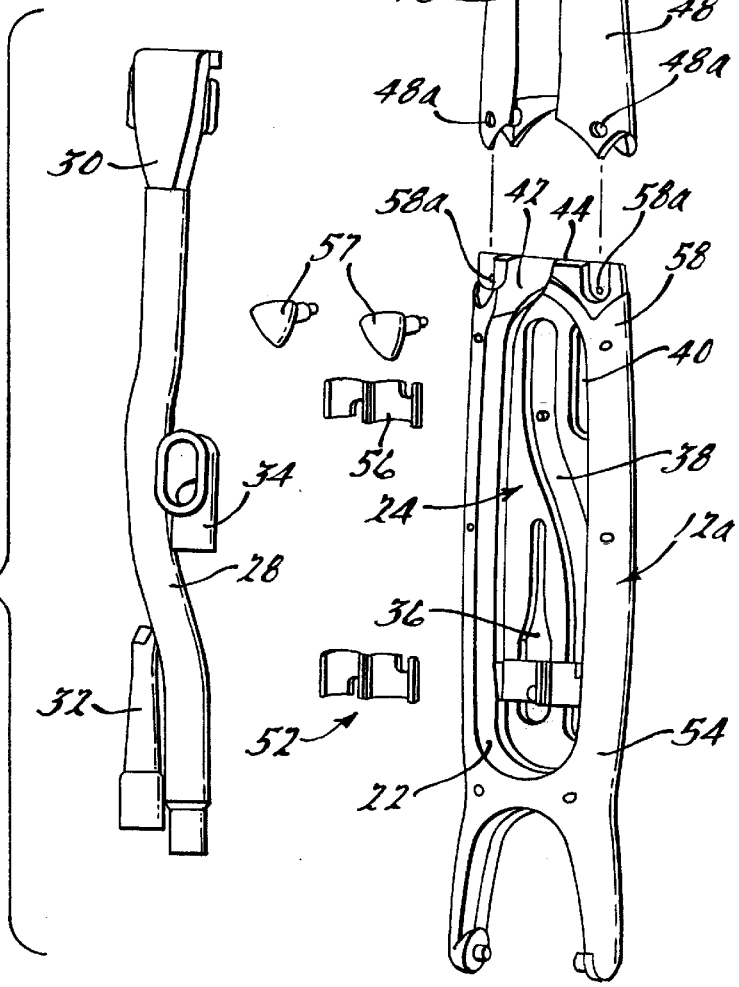
FIG. 2 is a rear perspective view of the upright handle shown in FIG. 1.

Referring to FIGS. 1 and 2, there is shown a vacuum cleaner system 10 in accordance with a preferred embodiment of the present invention. The vacuum cleaner system 10 incorporates an upright handle 12 which is pivotally secured to a powerhead 14. The powerhead 14 includes the typical vacuum cleaner components, i.e., a fan motor and a fan driven by the fan motor for generating a suction airflow. Since these components are well known components of vacuum cleaners, they have not been illustrated. A removable dirt receptacle 15 forms a container for holding dust, dirt and other debris filtered from the suction airflow drawn in by the powerhead 14.

Turning now to a more detailed description of the upright handle 12, this component is shown in FIGS. 1 and 2 as being of a two piece construction comprising a lower handle portion 12*a* and an upper handle portion 12*b*. The two handle portions 12*a* and 12*b* are secured fixedly to one another by a pair of threaded fastening members 18 from a rear surface 20 of the upright handle 12. Details of the structure associated with the interengaging portions of each of the handle portions 12*a* and 12*b* is disclosed in copending U.S. application Ser. No. 09/886,957 entitled "Two Piece Upright Handle Assembly For A Vacuum Cleaner System", assigned to the assignee of the present invention and filed concurrently herewith.

With further reference to FIGS. 1 and 2, the lower handle portion 12*a* includes an opening 22 within which is disposed a translucent tray 24. The translucent tray 24 includes a plurality of integrally formed recesses 36, 38 and 40 for partially housing specific accessory cleaning attachments such as crevice cleaning tools, extension wands, brush attachments, and a short length of auxiliary hose. These cleaning attachments are typically used in connection with the auxiliary cleaning hose, which is secured to the electric powerhead 14 through an intake port on an undersurface of the powerhead in a known manner.

It is a principal advantage of the upright handle 12 that the translucent tray 24 provides a means for compact storage of a plurality of cleaning accessory attachments within the interior area defined by the outer periphery of the lower handle portion 12*a*. Since one can see through the translucent tray 24, the user can instantly tell which cleaning attachments are supported on the tray 24 while viewing a front side (as shown in FIG. 1) of the tray. Thus, there is no need for a user to walk around to the rear of the upright handle 12 (as shown in FIG. 2) to determine which cleaning attachments are available for use. The translucent tray 24 also provides a aesthetically appealing means for displaying the cleaning attachments being supported thereon.

Referring to FIG. 3, the upright handle 12 is shown with the cleaning attachments removed from the translucent tray 24. In this example, the cleaning attachments comprise a length of auxiliary hose 28 having an attachment portion 30 designed to interface with an intake port on the undersurface of the powerhead 14, a crevice cleaning tool 32 and a brush 34. The recess 36 is formed in the translucent tray 24 for partially housing the crevice cleaning tool 32. The recess 38 partially houses the auxiliary hose 28, and the recess 40 partially houses the brush 34. Since the length of the auxiliary hose 28 is longer than the length of the lower housing portion 12*a*, an arcuate recess 42 is formed at an upper end 44 of the lower handle portion 12*a*. Similarly, an arcuate recess 46 is formed in a rear surface 48 of the upper handle portion 12*b*. A recess 50 is also formed in the rear surface 48 to accommodate the attachment portion 30 of the auxiliary hose 28.

With further reference to FIG. 3, a securing member 52 in the form of a W-shaped component is secured adjacent a lower end 54 of the lower handle portion 12*a*, while a second securing member 56 is secured at an upper end 58 of the lower handle portion. A third securing member 49 is formed in the recess 46 of the upper handle portion 12*b*. This component will be discussed in detail with reference to FIG. 7.

Each of the securing members 52 and 56 are adapted to releasably secure a pair of accessory attachments. Securing member 49 secures only the upper end of the auxiliary hose 28. In this example, securing member 52 secures crevice cleaning tool 32 and a lower end of the auxiliary hose 28. The other securing member 56 secures the upper end of the auxiliary hose 28 and the brush 34. The securing members 52 and 56 are preferably identical in construction. Threaded fastening members 57 extend through openings 48*a* and openings 58*a* when the two handle portions 12*a* and 12*b* are secured together to hold them securely assembled.

Figure 4:
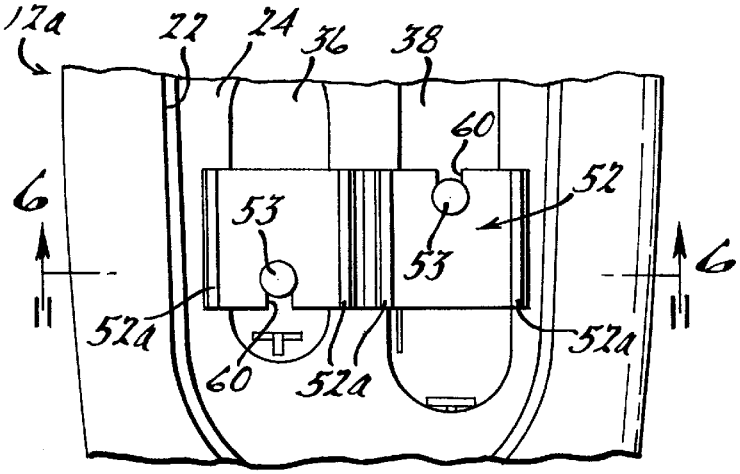
FIG. 4 is a plan view of the lower securing member secured to the translucent tray.
Figure 5:
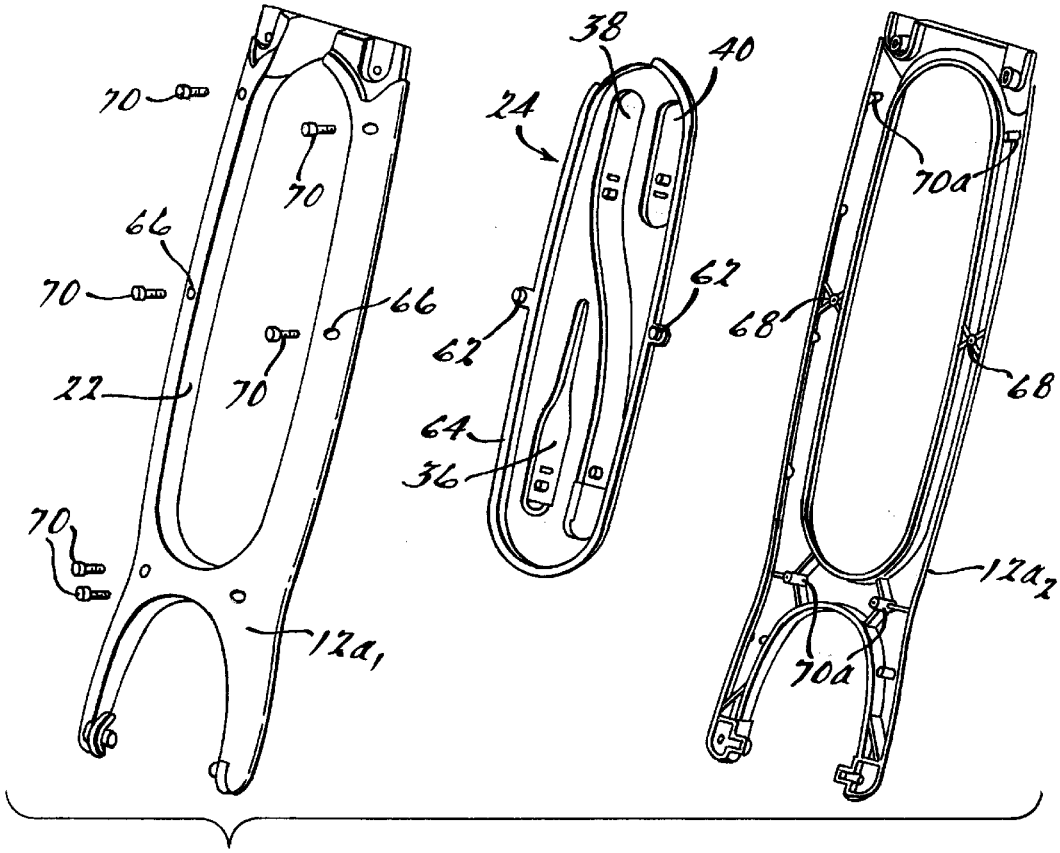
FIG. 5 is an exploded perspective view of the components forming the handle assembly.
Figure 6:
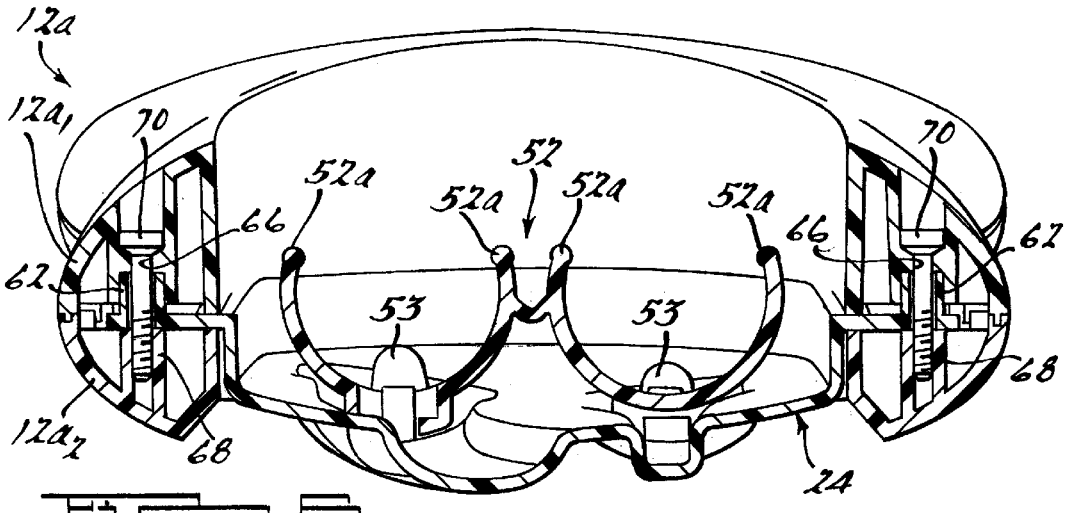
FIG. 6 is a cross-sectional view of the handle assembly taken in accordance with section line 6—6 in FIG. 4.

With reference to FIGS. 4 and 5, securing member 52 can be seen in greater detail. Arms 52*a* thereof form flexible members which allow portions of the crevice cleaning tool 32 and the auxiliary hose 28 to be "snapped" therebetween. These components can be easily removed without any external tools by simply grasping the desired tool and pulling outwardly away from the securing member 52.

The securing member 52 also includes a pair of openings 60 which allow it to be secured to posts formed on the translucent tray 24 by heat staking using mounting posts 53. It will be appreciated, however, that any suitable method of attaching the securing member 52 to the translucent tray 24 could be used, such as a threaded fastener assembly.

Referring now to FIG. 5, the translucent tray 24 can be seen in greater detail. The translucent tray 24 is sandwiched between a rear housing section $\mathbf{12}a_1$ and a front housing section $\mathbf{12}a_2$. The translucent tray 24 includes a pair of ear portions 62 each having holes which are used to secure the tray and orientate it within the opening 22 formed when the front and rear housing sections $\mathbf{12}a_2$ and $\mathbf{12}a_1$, respectively, are secured together. A peripheral flange 64 provides a surface for allowing the periphery of the translucent tray 24 to rest within the opening 22. The rear housing section $\mathbf{12}a_1$ includes a pair of holes 66 which are spaced in accordance with the spacing of the ear portions 62. The holes 66 are also spaced in accordance with a pair of threaded boss portions 68 formed in an innersurface of the front housing section $\mathbf{12}a_2$. Three pairs of fastening elements 70, such as threaded fastening elements, are used in connection with boss portions 68 and threaded openings 70*a* in the front housing section $\mathbf{12}a_2$ to secure the two housing sections $\mathbf{12}a_1$ and $\mathbf{12}a_2$ together over the translucent tray 24 such that the tray is sandwiched therebetween. It will be appreciated, however, that any suitable fastening elements could be employed besides threaded fastening elements.

It will also be appreciated that the translucent tray 24 forms a structural component of the upright handle 12. This serves to help make the handle 12 more structurally rigid and to impart an additional degree of strength to the handle.

Figure 7:
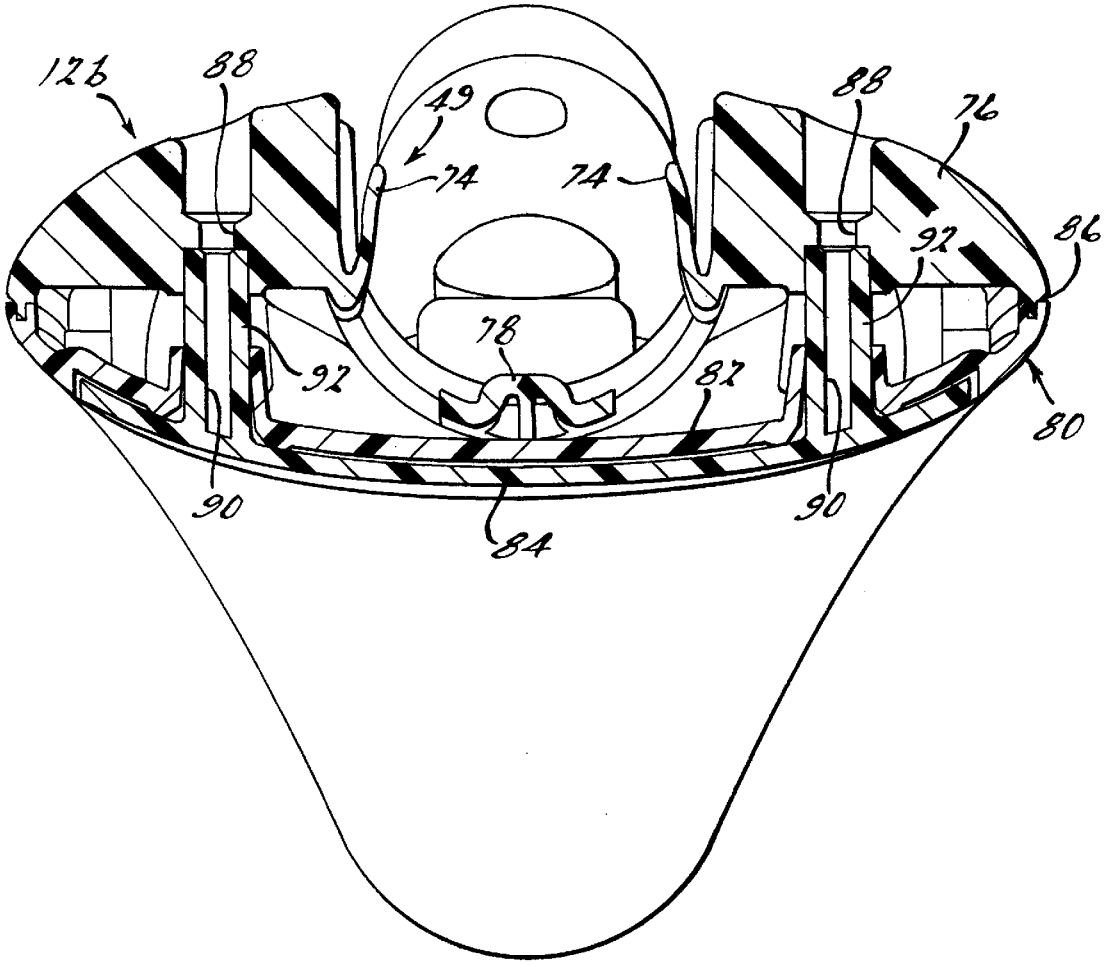
FIG. 7 is a cross-sectional end view taken in accordance with section line 7—7 in FIG. 1.

With brief reference to FIG. 7, the construction of the third securing member 49 can be seen in greater detail. The securing member 49 includes a pair of flexible arm portions 74 which are integrally formed from plastic material used to form a rear housing section 76 of the upper handle portion 12*b*. A lower support 78 is integrally formed from a first component 82 of a front housing assembly 80. A second component 84 is used to sandwich the first component 82 between it and a peripheral edge 86 of the first component 82. The second component 84 also forms a decorative member on which indicia of the manufacturer can be placed.

The flexible arm portions 74 allow the upper end of the auxiliary hose to be inserted therebetween and to maintain the attachment portion 30 within its associated recess 50. The housing section 76 and the front housing assembly 80 are held together by conventional threaded fasteners (not shown) which extend through openings 88 in the rear housing section 76 and into blind holes 90 within boss portions 92 of the second component 84.

The translucent tray 24 is preferably manufactured as a single piece component from a suitably strong plastic such as ABS plastic or polycarbonate. The securing members 52 and 56 are similarly formed as single piece components from plastic such as ABS plastic or another suitably strong plastic.

It will also be appreciated that while three accessory attachment components (i.e., components 32, 28 and 34) have been shown as being supported on the translucent tray 24, that the tray can readily be formed with a greater or lesser number of recesses 36–40 to accommodate a greater or lesser plurality of cleaning accessory attachments. Since the tray 24 is translucent, the cleaning accessory attachments secured within its recesses 36–40 can be seen from the front side of the vacuum cleaner 12 without the user having to walk behind the vacuum cleaner 10. The translucent tray 24 further forms a visually appealing means for supporting the accessory attachments 28, 32 and 34 thereon. Still further, supporting the cleaning attachments 28, 32 and 34 within the periphery of the lower handle portion 12*a* provides a compact arrangement making the vacuum cleaner 10 easier to store when not in use and less cumbersome to use.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A vacuum cleaner assembly having an upright handle for releasably supporting at least one cleaning accessory attachment, said vacuum cleaner comprising:

an electric powerhead assembly;

an upright handle securable to said electric powerhead for allowing a user to maneuver said electric powerhead assembly over a surface being cleaned;

said upright handle having a translucent tray having a recess shaped in accordance with at least one cleaning accessory attachment for at least partially housing said one cleaning accessory attachment therein; and said translucent tray permitting a user to view said one attachment from either a front side or a back side of said tray to enable a user to quickly identify a specific type of said cleaning accessory attachment and whether said cleaning accessory attachment is present on said tray.

2. The vacuum cleaner assembly of claim 1, further comprising a securing member fixedly secured to said translucent tray for releasably supporting said at least one cleaning accessory attachment component therein.

3. The vacuum cleaner of claim 1, wherein:

said upright handle comprises front and rear housing sections; and wherein said translucent tray is placed between said housing sections prior to said housing sections being secured together.

4. The vacuum cleaner of claim 3, wherein said translucent tray comprises at least one mounting ear portion for enabling said translucent tray to be secured to one of said front and rear housing sections.

5. The vacuum cleaner of claim 1, further comprising first and second accessory retaining members secured to said translucent tray for releasably retaining said accessory attachment within said tray.

6. The vacuum cleaner of claim 1, wherein said translucent tray is integrally formed as a single piece component from a translucent plastic.

7. A vacuum cleaner assembly having an upright handle for releasably supporting at least one cleaning accessory attachment, said vacuum cleaner comprising:

an electric powerhead assembly;

an upright handle securable to said electric powerhead for allowing a user to maneuver said electric powerhead assembly over a surface being cleaned;

said upright handle having a translucent tray having a plurality recesses shaped in accordance with a corresponding plurality of cleaning accessory attachments for housing said one cleaning accessory attachment therein;

at least one accessory attachment retaining member secured to said tray and adapted to releasably retain at least one of said accessory attachments therein; and said translucent tray enabling a user to quickly identify a specific type of said cleaning accessory attachment and whether said cleaning accessory attachment is present on said tray.

8. The vacuum cleaner assembly of claim 7, wherein said translucent tray is integrally formed as a single piece component from a translucent plastic.

9. The vacuum cleaner assembly of claim 7, wherein:

said upright handle is formed from a pair of housing sections; and wherein said translucent tray is sandwiched between said housing sections.

10. The vacuum cleaner assembly of claim 9, wherein said translucent tray comprises at least one ear portion adapted to engage with an interior portion of one of said housing sections to thereby precisely align said tray within said housing sections during assembly of said upright handle.

11. An upright handle for a vacuum cleaner, said upright handle comprising:

a housing having an opening;

a translucent tray disposed within said housing;

said translucent tray including at least one recess shaped in accordance with a specific accessory attachment for at least partially housing said specific accessory attachment; and a securing component operably associated with said translucent tray for releasably retaining said specific accessory attachment within said housing.

12. The upright handle of claim 11, wherein:

said housing includes front and rear sections each having a centrally disposed opening, said housing sections forming a unitary housing assembly;

said translucent tray including at least one ear portion adapted to engage with structure on an interior surface of one of said housing sections when said tray is placed over said opening of said one of said housing sections, to thereby help center said tray over said one of said housing sections prior to assembly of said housing sections into said housing.

13. The upright handle of claim 11, further comprising a retaining member secured to said translucent tray adjacent said recess for releasably retaining said accessory attachment adjacent said recess; and whereby said retaining member allows said accessory attachment to be removed therefrom without the use of any external tools.

14. The upright handle of claim 11, wherein said translucent tray comprises an integrally formed component made from generally translucent plastic.

15. A detachable handle adapted for use with a vacuum cleaner apparatus, said handle comprising:

a housing having an opening formed therein;

a translucent tray secured within the opening, said tray having a front side and a rear side and at least one recess adapted to accommodate a predetermined accessory cleaning attachment adjacent said recess;

a securing apparatus operably associated with said translucent tray for supporting said cleaning attachment adjacent said recess such that said cleaning attachment can be removed therefrom without the need for external hand tools; and wherein said tray enables a user to see whether said cleaning attachment is present on said tray from either said front side or said rear side thereof.

16. The handle of claim 15, wherein said translucent tray is formed from a translucent plastic.

17. The handle of claim 15, wherein said translucent tray is formed as a single piece component from a translucent plastic; and wherein said securing apparatus is coupled to said rear surface of said tray.

18. The handle of claim 17, wherein said housing comprises first and second sections; and wherein said translucent tray is sandwiched between said housing sections within said opening during assembly of said handle.

19. An upright handle adapted for use with a vacuum cleaner apparatus, said handle comprising:

a housing having an opening formed therein;

a translucent tray secured within the opening, said tray having a front side and a rear side and at least one recess adapted to accommodate a predetermined accessory cleaning attachment adjacent said recess;

wherein said tray enables a user to see whether said cleaning attachment is present on said tray from either said front side or said rear side thereof; and wherein said tray forms a structural member of said upright handle for adding structural rigidity and strength to said upright handle.

* * * * *

UNITED STATES PATENT AND TRADEMARK OFFICE

CERTIFICATE OF CORRECTION

PATENT NO. : 6,568,025 B2
DATED : May 27, 2003
INVENTOR(S) : Michael E. Waldron et al.

It is certified that error appears in the above-identified patent and that said Letters Patent is hereby corrected as shown below:

Title page,
Item [75], Inventors, add the following:
-- Murray D. Hunter, Kingston (CA);
Richard P. Rosa, Kingston (CA) --.

Signed and Sealed this

Thirtieth Day of December, 2003

JAMES E. ROGAN
*Director of the United States Patent and Trademark Office*